US009863210B2

(12) United States Patent
Ezell et al.

(10) Patent No.: US 9,863,210 B2
(45) Date of Patent: Jan. 9, 2018

(54) PACKER ASSEMBLY HAVING SEQUENTIALLY OPERATED HYDROSTATIC PISTONS FOR INTERVENTIONLESS SETTING

(75) Inventors: Michael Dale Ezell, Carrollton, TX (US); Beauford Sean Mallory, Sachse, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 393 days.

(21) Appl. No.: 14/409,141

(22) PCT Filed: Jul. 2, 2012

(86) PCT No.: PCT/US2012/045266

§ 371 (c)(1),
(2), (4) Date: Apr. 17, 2015

(87) PCT Pub. No.: WO2014/007801

PCT Pub. Date: Jan. 9, 2014

(65) Prior Publication Data

US 2015/0292296 A1 Oct. 15, 2015

(51) Int. Cl.
*E21B 33/128* (2006.01)
*E21B 23/06* (2006.01)
*E21B 33/124* (2006.01)

(52) U.S. Cl.
CPC ..... *E21B 33/1285* (2013.01); *E21B 23/06* (2013.01); *E21B 33/124* (2013.01); *E21B 33/128* (2013.01)

(58) Field of Classification Search
CPC ..... E21B 23/06; E21B 33/124; E21B 33/128; E21B 33/1285
See application file for complete search history.

(56) References Cited

U.S. PATENT DOCUMENTS

2007/0151734 A1 7/2007 Fehr et al.
2007/0246227 A1 10/2007 Ezell et al.
(Continued)

OTHER PUBLICATIONS

International Search Report and the Written Opinion of the International Searching Authority, or the Declaration, dated Feb. 27, 2013, PCT/US2012/045266, 10 pages, International Searching Authority, KR.

(Continued)

*Primary Examiner* — Giovanna C Wright
*Assistant Examiner* — Manuel C Portocarrero
(74) *Attorney, Agent, or Firm* — Haynes & Boone LLP

(57) ABSTRACT

A packer for use in a wellbore includes a packer mandrel. First and second pistons are slidably disposed about the packer mandrel defining first and second chambers therewith. An activation assembly initially prevents movement of the first piston. A release assembly initially prevents movement of the second piston. First and second seal assemblies are disposed about the packer mandrel such that actuation of the activation assembly allows a force generated by a pressure difference between the wellbore and the first chamber to shift the first piston in a first direction toward the first seal assembly to radially expand the first seal assembly and to actuate the release assembly and, actuation of the release assembly allows a force generated by a pressure difference between the wellbore and the second chamber to shift the second piston in the first direction toward the second seal assembly to radially expand the second seal assembly.

20 Claims, 10 Drawing Sheets

(56) References Cited

U.S. PATENT DOCUMENTS

| | | | | |
|---|---|---|---|---|
| 2009/0065192 | A1 | 3/2009 | Lucas | |
| 2010/0012330 | A1* | 1/2010 | Ezell | E21B 33/1285 166/387 |
| 2012/0012343 | A1* | 1/2012 | Wilkin | E21B 33/1243 166/387 |
| 2012/0160521 | A1 | 6/2012 | McGlothen et al. | |

OTHER PUBLICATIONS

Extended Search Report issued for European Patent Application No. 12880470, dated Jul. 1, 2016, 8 pages.

* cited by examiner

PACKER ASSEMBLY HAVING SEQUENTIALLY OPERATED HYDROSTATIC PISTONS FOR INTERVENTIONLESS SETTING

The present application is a U.S. National Stage patent application of International Patent Application No. PCT/US2012/045266, filed on Jul. 2, 2012, the benefit of which is claimed and the disclosure of which is incorporated herein by reference in its entirety.

TECHNICAL FIELD OF THE INVENTION

This invention relates, in general, to equipment utilized in conjunction with operations performed in subterranean wells and, in particular, to a packer assembly having sequentially operated hydrostatic pistons for interventionless setting of multiple seal assemblies.

BACKGROUND OF THE INVENTION

Without limiting the scope of the present invention, its background will be described in relation to setting packers, as an example.

In the course of preparing a subterranean well for hydrocarbon production, one or more packers are commonly installed in the well. The purpose of the packers is to support production tubing and other completion equipment and to provides a seal in the well annulus between the outside of the production tubing and the inside of the well casing to isolate fluid and pressure thereacross.

Certain production packers are set hydraulically by establishing a differential pressure across a setting piston. Typically, this is accomplished by running a tubing plug on wireline, slick line, electric line, coiled tubing or another conveyance into the production tubing to a profile location. Fluid pressure within the production tubing may then be increased, thereby creating a pressure differential between the fluid within the production tubing and the fluid in the wellbore annulus. This pressure differential actuates the setting piston to expand the seal assembly of the production packer into sealing engagement with the casing. Thereafter, the tubing plug is retrieved to the surface such that production operations may begin.

As operators increasingly pursue production in deeper water offshore wells, highly deviated wells and extended reach wells, for example, the rig time required to set the tubing plug and thereafter retrieve the tubing plug can negatively impact the economics of the project, as well as add unnecessary complications and risks. To address these issues associated with hydraulically set packers, interventionless packer setting techniques have been developed. For example, a hydrostatically actuated setting module has been incorporated into the bottom end of a packer to exert an upward setting force on the packer piston. The hydrostatic setting module may be actuated by applying pressure to the production tubing and the wellbore at the surface, with the setting force being generated by a combination of the applied surface pressure and the hydrostatic pressure associated with the fluid column in the wellbore.

In operation, once the packer is positioned at the required setting depth, surface pressure is applied to the production tubing and the wellbore annulus until a port isolation device actuates, thereby allowing wellbore fluid to enter an initiation chamber on one side of the piston while the chamber engaging the other side of the piston remains at an evacuated pressure. This creates a differential pressure across the piston that causes the piston to move, beginning the setting process. Once the setting process begins, O-rings in the initiation chamber move off seat to open a larger flow area such that fluid entering the initiation chamber continues actuating the piston to complete the setting process. Therefore, the bottom-up hydrostatic setting module provides an interventionless method for setting packers as the setting force is provided by available hydrostatic pressure and applied surface pressure without plugs or other well intervention devices.

It has been found, however, that the bottom-up hydrostatic setting module may not be ideal for applications where the wellbore annulus and production tubing cannot be pressured up simultaneously. Such applications include, for example, when a packer is used to provide liner top isolation or when a packer is landed inside an adjacent packer in a stacked packer completion. In such circumstances, if a bottom-up hydrostatic setting module is used to set a packer above another sealing device, there is only a limited annular region between the unset packer and the previously set sealing device below. Therefore, when the operator pressures up on the wellbore annulus, the hydrostatic pressure begins actuating the bottom-up hydrostatic setting module to exert an upward setting force on the piston. When the packer sealing elements start to engage the casing, however, the limited annular region between the packer and the lower sealing device becomes closed off and can no longer communicate with the upper annular area that is being pressurized from the surface. Thus, the trapped pressure in the limited annular region between the packer and the lower sealing device is soon dissipated and may not fully set the packer.

Accordingly, a need has arisen for improved packer for providing a seal between a tubular string and a wellbore surface. In addition, a need has arisen for such an improved packer that does not require a plug to be tripped into and out of the well to enable setting. Further, a need has arisen for such an improved packer that is operable to be set without the application of both tubing pressure and annulus pressure.

SUMMARY OF THE INVENTION

The present invention disclosed herein comprises a packer assembly having sequentially operated hydrostatic pistons for interventionless setting of multiple seal assemblies that is operable to provide a seal between a tubular string and a wellbore surface. The packer assembly of the present invention does not require a plug to be tripped into and out of the well to enable setting. In addition, the packer assembly of the present invention is operable to be set without the application of both tubing pressure and annulus pressure.

In one aspect, the present invention is directed to a packer assembly for use in a wellbore. The packer assembly includes a packer mandrel. A first piston is slidably disposed about the packer mandrel defining a first chamber therewith. An activation assembly is disposed about the packer mandrel initially preventing movement of the first piston. A first seal assembly is disposed about the packer mandrel and is operably associated with the first piston. A second piston is slidably disposed about the packer mandrel defining a second chamber therewith. A release assembly is disposed about the packer mandrel initially preventing movement of the second piston. A second seal assembly is disposed about the packer mandrel and is operably associated with the second piston such that actuation of the activation assembly allows a force generated by a pressure difference between the wellbore and the first chamber to shift the first piston in a first direction toward the first seal assembly to radially expand the first seal assembly and to actuate the release assembly and such that actuation of the release assembly allows a force generated by a pressure difference between the wellbore and the second chamber to shift the second piston in the first direction toward the second seal assembly to radially expand the second seal assembly.

In some embodiments, the activation assembly may include a housing section at least partially disposed about the packer mandrel that defines an activation chamber with the packer mandrel and the first piston. In these embodiments, a pressure actuated element may be positioned in a fluid flow path between the wellbore and the activation chamber initially preventing fluid flow therethrough until wellbore pressure exceeds a predetermined actuation pressure. Also, in these embodiments, a frangible member may initially couple the first piston to the housing section. In certain embodiments, the release assembly may include a release sleeve disposed about the packer mandrel that is operably associated with the first seal assembly. In these embodiments, a collet assembly may be disposed about the packer mandrel that initially prevents movement of the second piston. Also, in these embodiments, a frangible member may initially couple the release sleeve to the packer mandrel. In one embodiment, a first body lock ring disposed about the packer mandrel may be operable to prevent release of the first seal assembly after radial expansion of the first seal assembly. In other embodiments, at least one second body lock ring disposed about the packer mandrel may be operable to prevent release of the second seal assembly after radial expansion of the second seal assembly.

In another aspect, the present invention is directed to a method for setting a packer assembly in a wellbore. The method includes providing a packer assembly having a packer mandrel with first and second seal assemblies disposed thereabout; running the packer assembly into the wellbore; preventing movement of a first piston toward the first seal assembly with an activation assembly disposed about the packer mandrel; preventing movement of a second piston toward the second seal assembly with a release assembly disposed about the packer mandrel; actuating the activation assembly to allow a force generated by a pressure difference between the wellbore and a first chamber defined between the first piston and the packer mandrel to shift the first piston in a first direction toward the first seal assembly to radially expand the first seal assembly; and actuating the release assembly responsive to the shifting of the first piston to allow a force generated by a pressure difference between the wellbore and a second chamber defined between the second piston and the packer mandrel to shift the second piston in the first direction toward the second seal assembly to radially expand the second seal assembly.

The method may also include bursting a pressure actuated element responsive to an increase in wellbore pressure to a predetermined actuation pressure, pressurizing an activation chamber disposed between a housing section, the packer mandrel and the first piston, exposing a first piston area of the first piston to wellbore pressure, breaking a frangible member coupling the first piston to the housing section, breaking a frangible member coupling a release sleeve to the packer mandrel, radially inwardly compressing a collet assembly with the release sleeve and/or unlatching the second piston from the collet assembly.

In a further aspect, the present invention is directed to a packer assembly for use in a wellbore. The packer assembly includes a packer mandrel. A first piston is slidably disposed about the packer mandrel defining a first chamber therewith. An activation assembly is disposed about the packer mandrel initially preventing movement of the first piston. A seal assembly is disposed about the packer mandrel and is operably associated with the first piston. A second piston is slidably disposed about the packer mandrel defining a second chamber therewith. A release assembly is disposed about the packer mandrel initially preventing movement of the second piston such that actuation of the activation assembly allows a force generated by a pressure difference between the wellbore and the first chamber to shift the first piston in a first direction toward the seal assembly to radially expand the seal assembly and to actuate the release assembly and such that actuation of the release assembly allows a force generated by a pressure difference between the wellbore and the second chamber to shift the second piston in the first direction.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the present invention.

Figure 1:
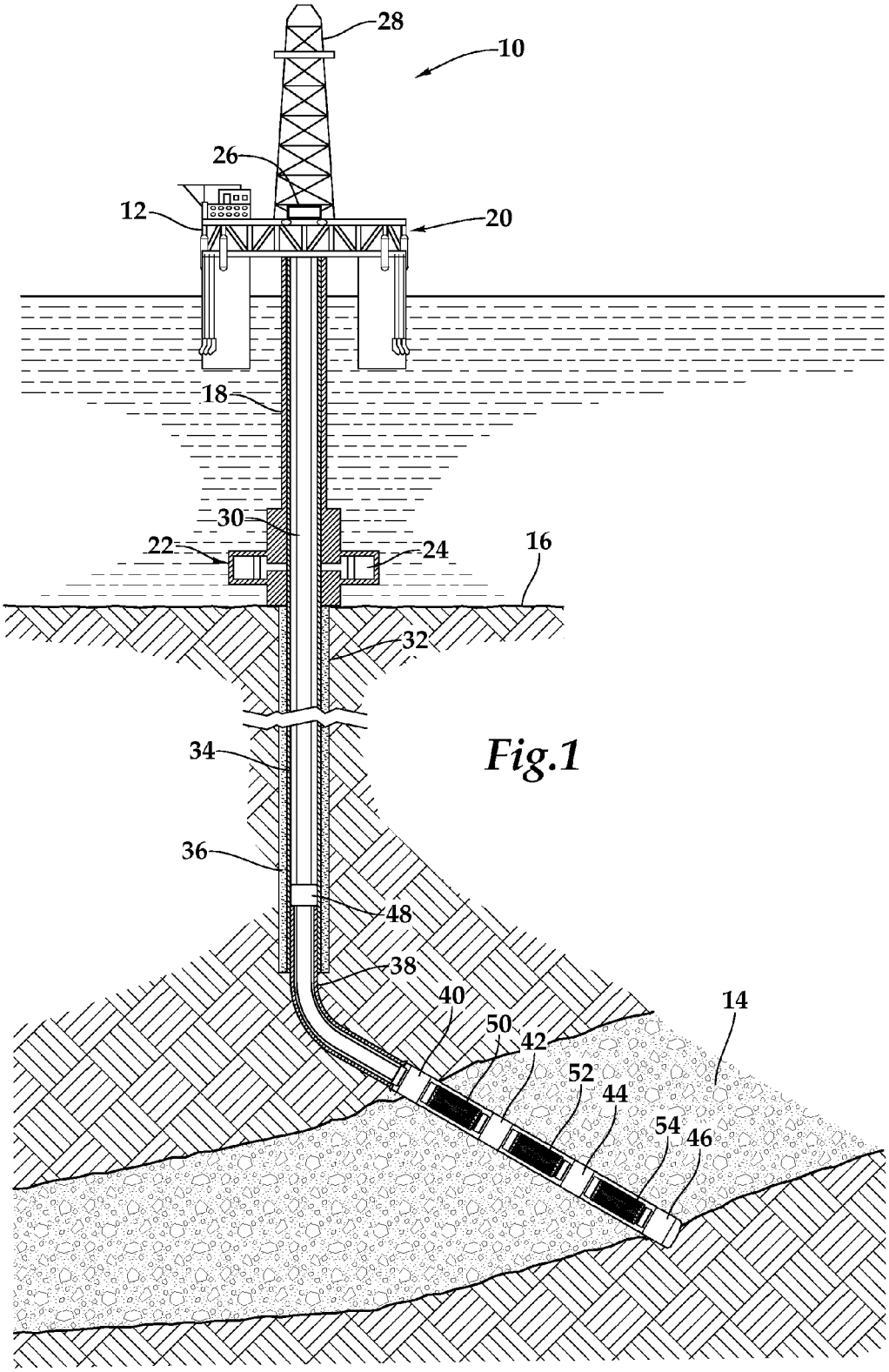
FIG. 1 is a schematic illustration of an offshore platform operating a plurality of packer assemblies having sequentially operated hydrostatic pistons for interventionless setting of multiple seal assemblies in accordance with an embodiment of the present invention.

Referring initially to FIG. 1, a plurality of packer assemblies having sequentially operated hydrostatic pistons for interventionless setting of multiple seal assemblies are being installed in an offshore oil or gas well that is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26 and a derrick 28 for raising and lowering pipe strings, such as work string 30.

A wellbore 32 extends through the various earth strata including formation 14. A casing 34 is secured within a vertical section of wellbore 32 by cement 36. An upper end of a liner 38 is secured to the lower end of casing 34 by a suitable liner hanger. Note that, in this specification, the terms "liner" and "casing" are used interchangeably to describe tubular materials, which are used to form protective linings in wellbores. Liners and casings may be made from any material such as metals, plastics, composites, or the like, may be expanded or unexpanded as part of an installation procedure. Additionally, it is not necessary for a liner or casing to be cemented in a wellbore.

Work string 30 may include one or more packer assemblies 40, 42, 44, 46, 48 of the present invention that may be located proximal to the top of liner 38 or as part of the completion to provide zonal isolation. Packer assemblies 40, 42, 44, 46, 48 include sequentially operated hydrostatic pistons for interventionless setting of multiple seal assemblies. When set, packer assemblies 40, 42, 44, 46 isolate zones of the annulus between wellbore 32 and completion string, while packer assembly 48 provides a seal between tubular string 30 and casing 34. In addition, the completion includes sand control screen assemblies 50, 52, 54 that are located substantially proximal to formation 14. As shown, packer assemblies 40, 42, 44, 46 may be located above and below each set of sand control screen assemblies 50, 52, 54. In this manner, formation fluids from formation 14 may enter sand control screen assemblies 50, 52, 54 between packer assemblies 40, 42, between packer assemblies 42, 44 and between packer assemblies 44, 46, respectively.

Even though FIG. 1 depicts the packer assemblies of the present invention in a slanted wellbore, it should be understood by those skilled in the art that the present invention is equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 1 depicts an offshore operation, it should be understood by those skilled in the art that the packer assemblies of the present invention are equally well suited for use in onshore operations.

Referring now to FIGS. 2A-2F, therein are depicted successive axial sections of a packer assembly having dual hydrostatic pistons for redundant interventionless setting that is representatively illustrated and generally designated 100. Packer assembly 100 includes an upper adaptor 102 that may be threadably coupled to another downhole tool or tubular as part of a tubular string as described above. At its lower end, upper adaptor 102 is threadably coupled to an upper end of packer mandrel 104. In the illustrated embodiment, packer mandrel 104 includes an upper packer mandrel section 106, an upper intermediate mandrel section 108, a lower intermediate mandrel section 110 and a lower mandrel section 112, each of which is threadably coupled to the adjacent sections. Packer assembly 100 includes a lower adaptor 114 that is threadably coupled to a lower end of packer mandrel 104 and that may be threadably coupled to another downhole tool or tubular at its lower end to form part of a tubular string as described above.

Packer mandrel 104 includes a plurality of receiving profiles 116, 118, 120, 122, 124, 126. Packer mandrel 104 also includes a plurality of sealing profiles 128, 130, 132, 134, each of which includes multiple sealing elements such as O-rings or other packing elements. Positioned around an upper portion of packer mandrel 104 is an upper housing section 136. Upper housing section 136 includes a connection ring 138, an upper connector 140 and an upper activation assembly 142 that is threadably coupled to upper connector 140. Upper activation assembly 142 includes a sealing profile 144 having multiple sealing elements to provide sealing engagement with packer mandrel 104. Upper activation assembly 142 and packer mandrel 104 form an upper activation chamber 146 therebetween. Upper activation assembly 142 includes one or more radial fluid passageways 148 that are depicted as having pressure actuated elements such as rupture disks 150 disposed therein in FIG. 2A. Upper activation assembly 142 also includes a pin groove 152 and a sealing profile 154 having multiple sealing elements.

Slidably disposed about packer mandrel 104 is an upper piston 156 that includes a plurality of threaded openings 158 and has a sealing profile 160 having multiple sealing elements. Upper piston 156 is initially coupled to upper activation assembly 142 by a plurality of frangible members depicted a shear screws 162. In this configuration shown in FIG. 2A, activation chamber 146 is defined between upper piston 156, upper activation assembly 142 and packer mandrel 104. At its lower end, upper piston 156 is threadably coupled to a body lock assembly 164 that includes a body lock ring 166 having teeth located along its inner surface for providing a gripping arrangement with packer mandrel 104. A seal assembly 168, depicted as expandable seal elements 170, 172, 174, is slidably positioned around packer mandrel 104 between body lock assembly 164 and a release assembly 176. In the illustrated embodiment, even though three expandable seal elements 170, 172, 174 are depicted and described, those skilled in the art will recognizes that a seal assembly of the packer of the present invention may have an alternate design including any number of seal elements.

Release assembly 176 includes a release sleeve 178 and a collet assembly 180. Release sleeve 178 is initially coupled to packer mandrel 104 by a plurality of frangible members depicted shear screws 182. Collet assembly 180 is supported between a pair of connection rings 184, 186. Collet assembly 180 is initially coupled to an upper intermediate piston 188 that has a sealing profile 190 having multiple sealing elements. At its lower end, upper intermediate piston 188 is threadably coupled to a body lock assembly 192 that includes a body lock ring 194 having teeth located along its inner surface for providing a gripping arrangement with packer mandrel 104. A seal assembly 196, depicted as expandable seal elements 198, 200, 202, is slidably positioned around packer mandrel 104 between body lock assembly 192 and a body lock assembly 204 that includes a body lock ring 206 having teeth located along its inner surface for providing a gripping arrangement with packer mandrel 104. In the illustrated embodiment, even though three expandable seal elements 198, 200, 202 are depicted and described, those skilled in the art will recognizes that a seal assembly of the packer of the present invention may have an alternate design including any number of seal elements.

At its lower end, body lock ring 204 is threadably coupled to a lower intermediate piston 208 that has a sealing profile 210 having multiple sealing elements. Lower intermediate piston 208 is initially coupled to a release assembly 212.

Release assembly 212 includes a release sleeve 214 and a collet assembly 216. Release sleeve 214 is initially coupled to packer mandrel 104 by a plurality of frangible members depicted shear screws 218. Collet assembly 216 is supported between a pair of connection rings 220, 222. A seal assembly 224, depicted as expandable seal elements 226, 228, 230, is slidably positioned around packer mandrel 104 between release assembly 214 and a body lock assembly 232 that includes a body lock ring 234 having teeth located along its inner surface for providing a gripping arrangement with packer mandrel 104. In the illustrated embodiment, even though three expandable seal elements 226, 228, 230 are depicted and described, those skilled in the art will recognizes that a seal assembly of the packer of the present invention may have an alternate design including any number of seal elements.

At its lower end, body lock assembly 232 is threadably coupled to a lower piston 236 that has a sealing profile 238 having multiple sealing elements and a plurality of threaded openings 240. Positioned around a lower portion of packer mandrel 104 is a lower housing section 242. Lower housing section 242 includes a connection ring 244, a lower connector 246 and a lower activation assembly 248 that is threadably coupled to lower connector 246. Lower activation assembly 248 includes a sealing profile 250 having multiple sealing elements to provide sealing engagement with packer mandrel 104. Lower activation assembly 248 and packer mandrel 104 form a lower activation chamber 252 therebetween. Lower activation assembly 248 includes one or more radial fluid passageways 254 that are depicted as having pressure actuated elements such as rupture disks 256 disposed therein in FIG. 2E. Lower activation assembly 248 also includes a pin groove 258 and a sealing profile 260 having multiple sealing elements. Lower piston 236 is initially coupled to lower activation assembly 248 by a plurality of frangible members depicted shear screws 262. In this configuration shown in FIG. 2F, lower activation chamber 252 is defined between lower piston 236, lower activation assembly 248 and packer mandrel 104.

Figure 2A:
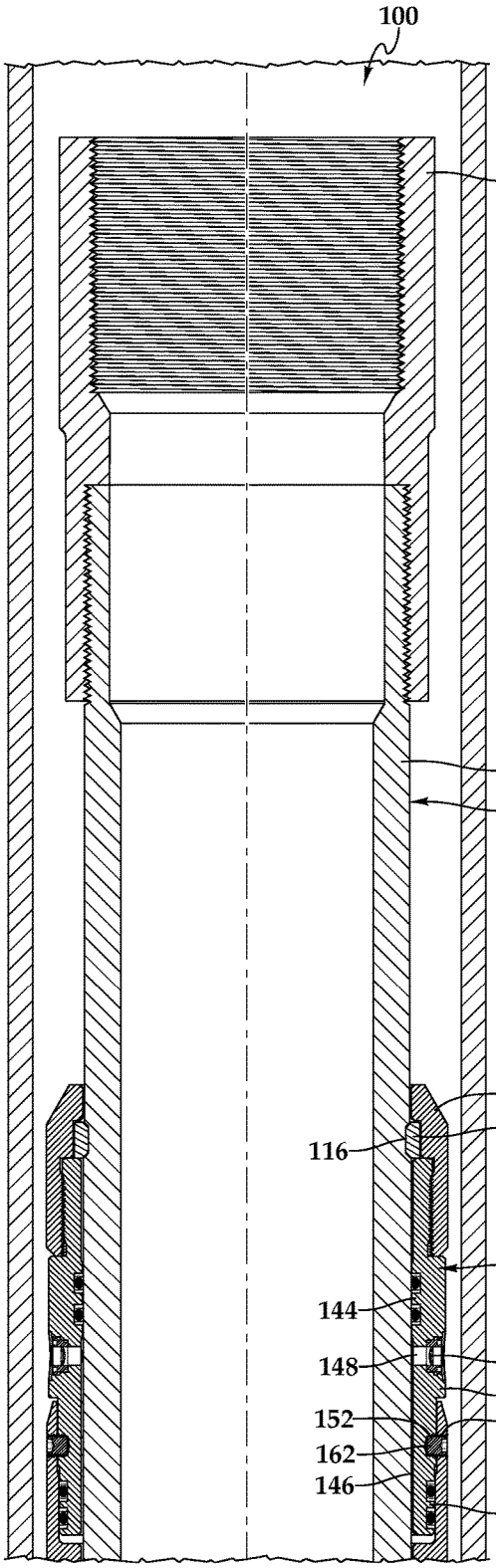
FIGS. 2A-2F are cross-sectional views of consecutive axial sections of a packer assembly having sequentially operated hydrostatic pistons for interventionless setting of multiple seal assemblies in accordance with an embodiment of the present invention in its running configuration.
Figure 2B:
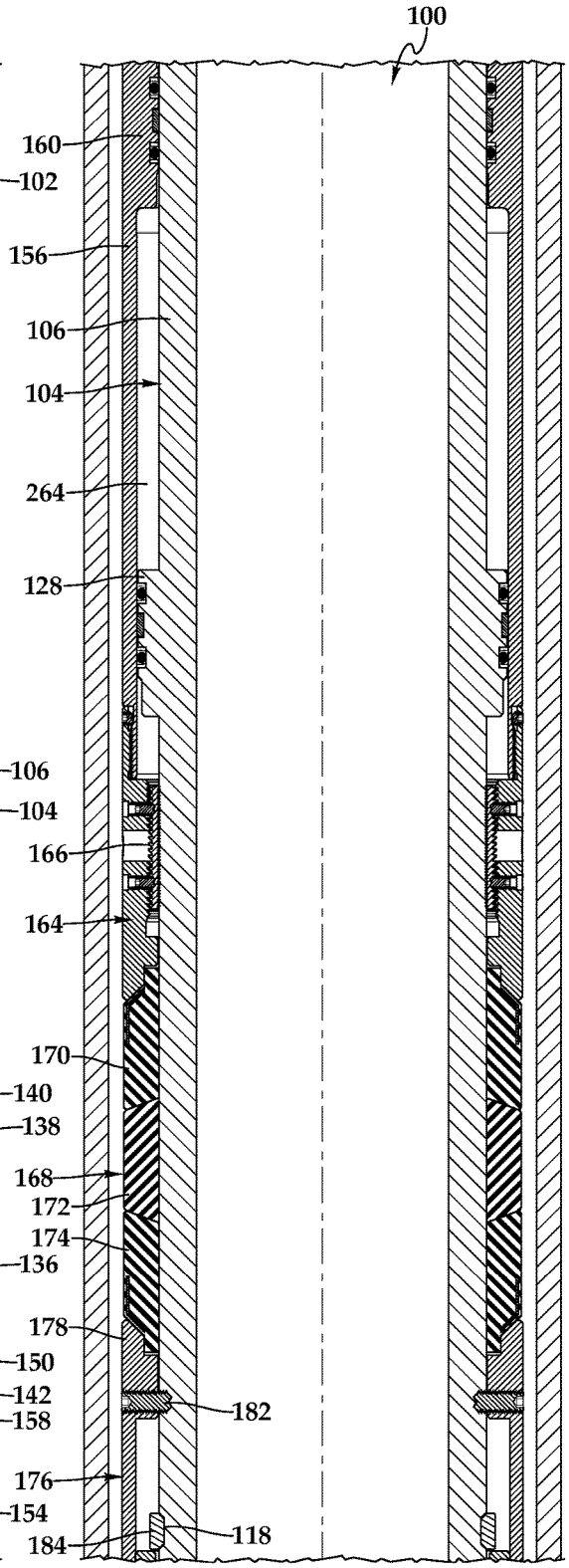
Figures 2C, 2D:
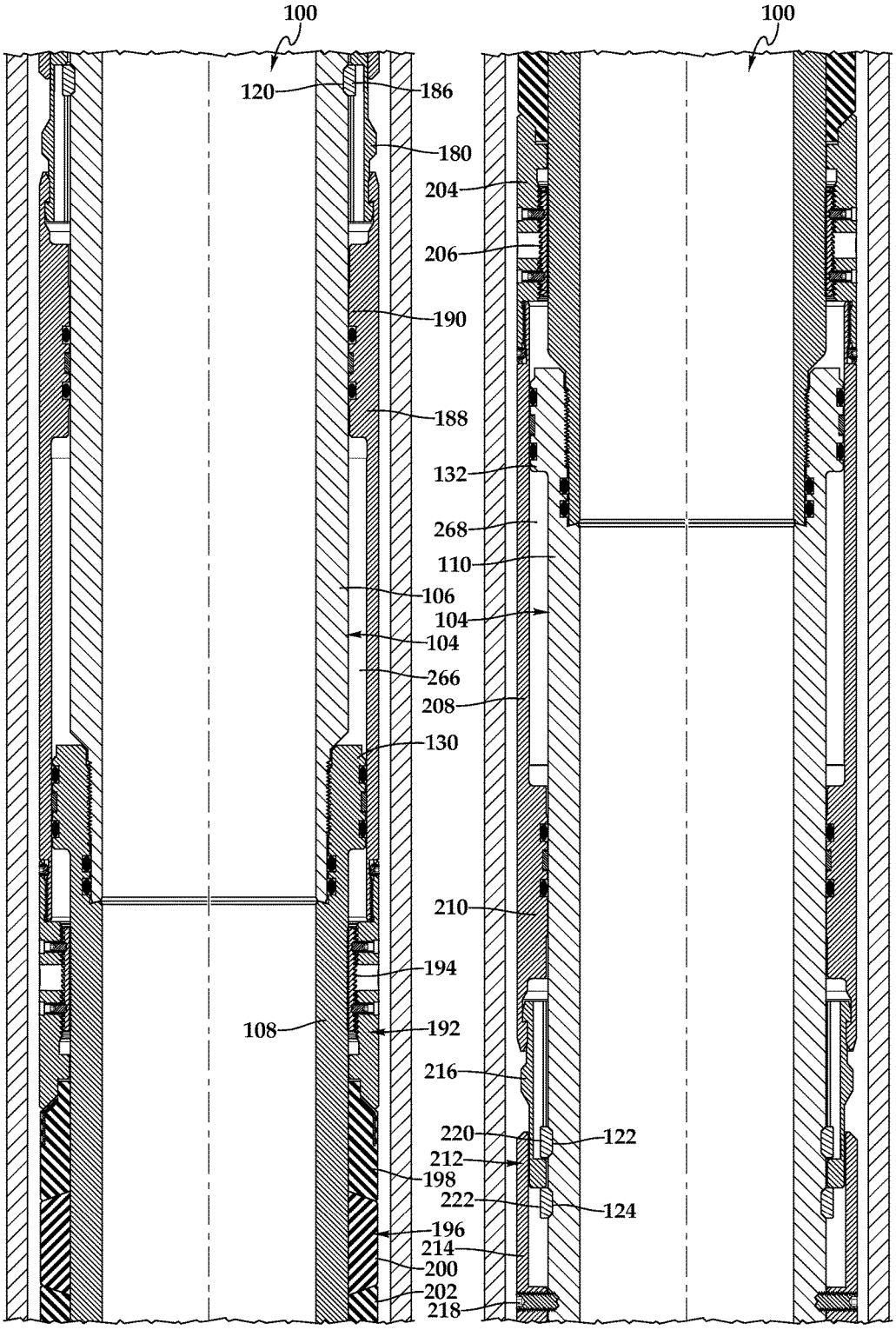
Figures 2E, 2F:
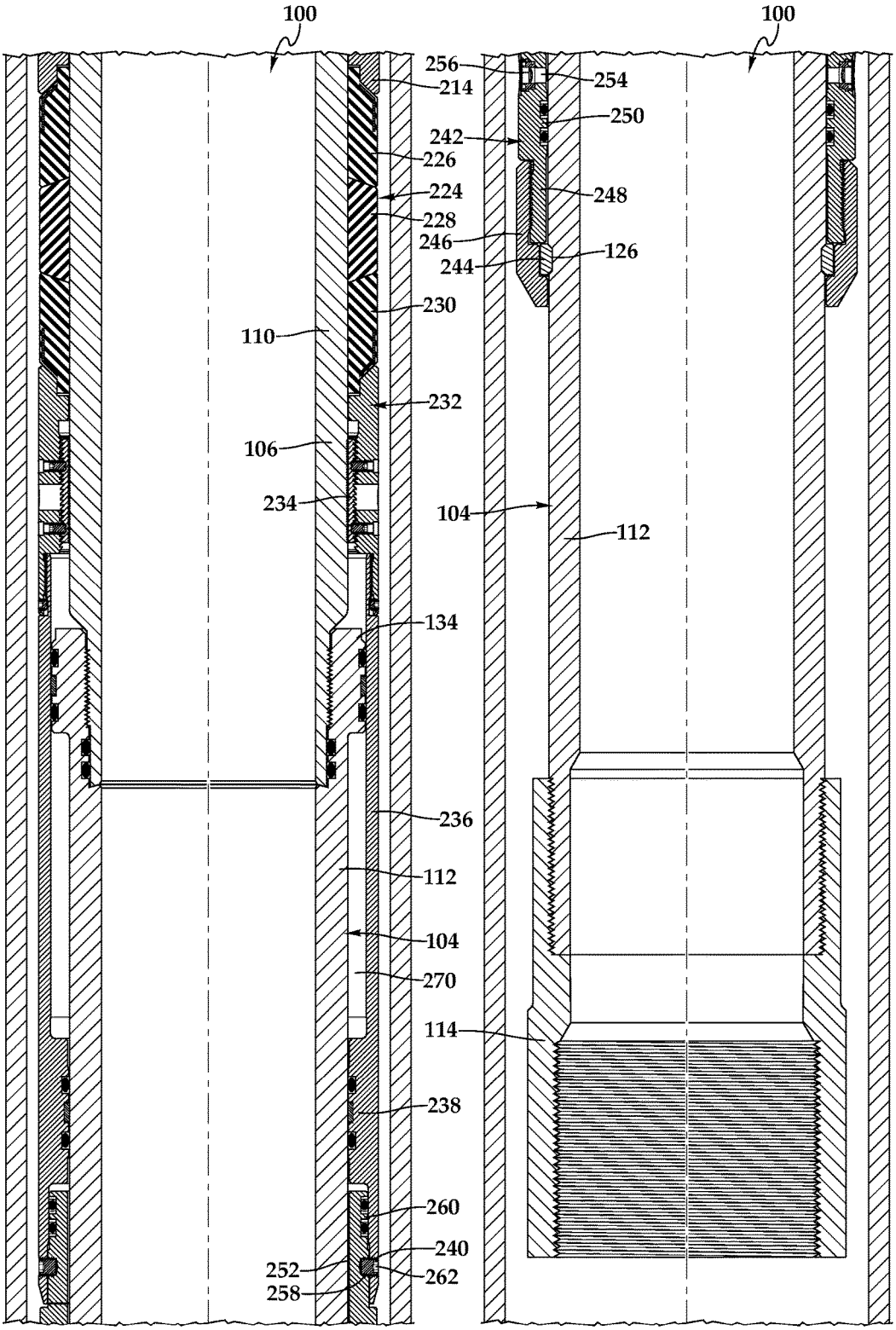

As best seen in FIG. 2B, an atmospheric chamber 264 is disposed between upper piston 156 and packer mandrel 104 and more particularly between sealing profile 160 of upper piston 156 and sealing profile 128 of packer mandrel 104. As best seen in FIG. 2C, an atmospheric chamber 266 is disposed between upper intermediate piston 188 and packer mandrel 104 and more particularly between sealing profile 190 of upper intermediate piston 188 and sealing profile 130 of packer mandrel 104. As best seen in FIG. 2D, an atmospheric chamber 268 is disposed between lower intermediate piston 208 and packer mandrel 104 and more particularly between sealing profile 210 of lower intermediate piston 208 and sealing profile 132 of packer mandrel 104. As best seen in FIG. 2E, an atmospheric chamber 270 is disposed between lower piston 236 and packer mandrel 104 and more particularly between sealing profile 238 of lower piston 236 and sealing profile 134 of packer mandrel 104. Preferably, atmospheric chambers 264, 266, 268, 270 are initially evacuated by pulling a vacuum.

Referring collectively to FIGS. 2A-2F, 3A-3F and 4A-4F, the operation of packer assembly 100 will now be described. Packer assembly 100 is shown before, during and after activation and expansion of seal assemblies 168, 196, 224, respectively, in FIGS. 2A-2F, 3A-3F and 4A-4F. Packer assembly 100 may be run into a wellbore on a work string or similar tubular string to a desired depth and then set against a casing string, a liner string or other wellbore surface including an open hole surface. It is noted that during run in, movement of upper piston 156 is initially prevented as upper piston 156 is initially coupled to upper activation assembly 142 by shear screws 162 and due to the presence of rupture disks 150 in fluid passageways 148 of upper activation assembly 142 which prevent fluid pressure from entering upper activation chamber 146. Movement of upper intermediate piston 188 is initially prevented by release assembly 176 as release sleeve 178 is initially coupled to packer mandrel 104 by shear screws 182 and collet assembly 180 is initially coupled to upper intermediate piston 188. Movement of lower intermediate piston 208 is initially prevented by release assembly 212 as release sleeve 214 is initially coupled to packer mandrel 104 by shear screws 218 and collet assembly 216 is initially coupled to lower intermediate piston 208. Movement of lower piston 236 is initially prevented as lower piston 236 is initially coupled to lower activation assembly 248 by shear screws 262 and due to the presence of rupture disks 256 in fluid passageways 254 of lower activation assembly 248 which prevent fluid pressure from entering lower activation chamber 252.

Figure 3A:
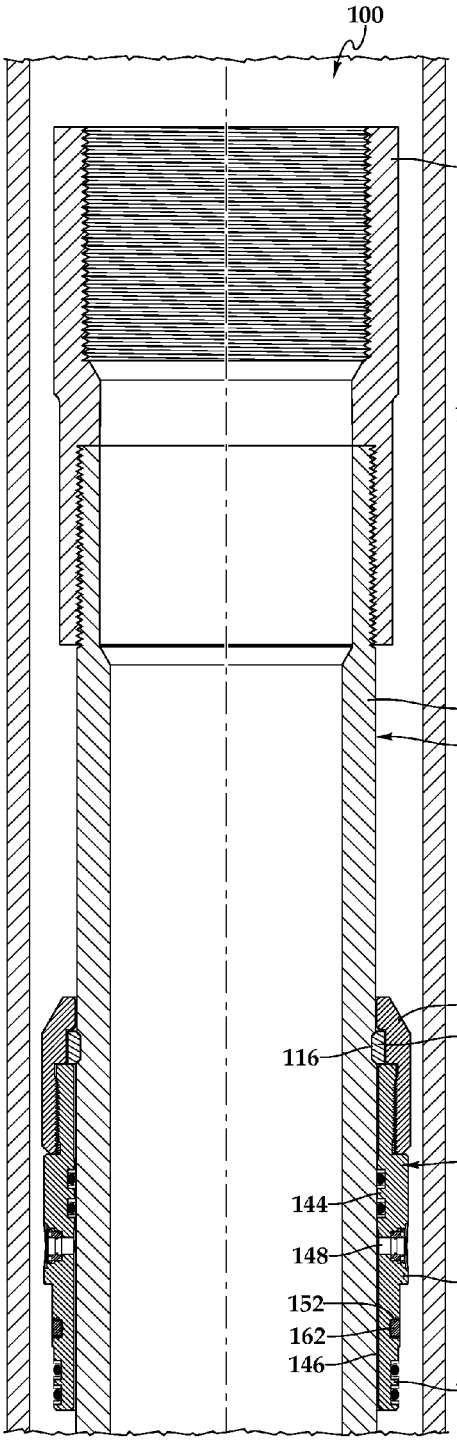
FIGS. 3A-3F are cross-sectional views of consecutive axial sections of a packer assembly having sequentially operated hydrostatic pistons for interventionless setting of multiple seal assemblies in accordance with an embodiment of the present invention during the setting process.
Figure 3B:
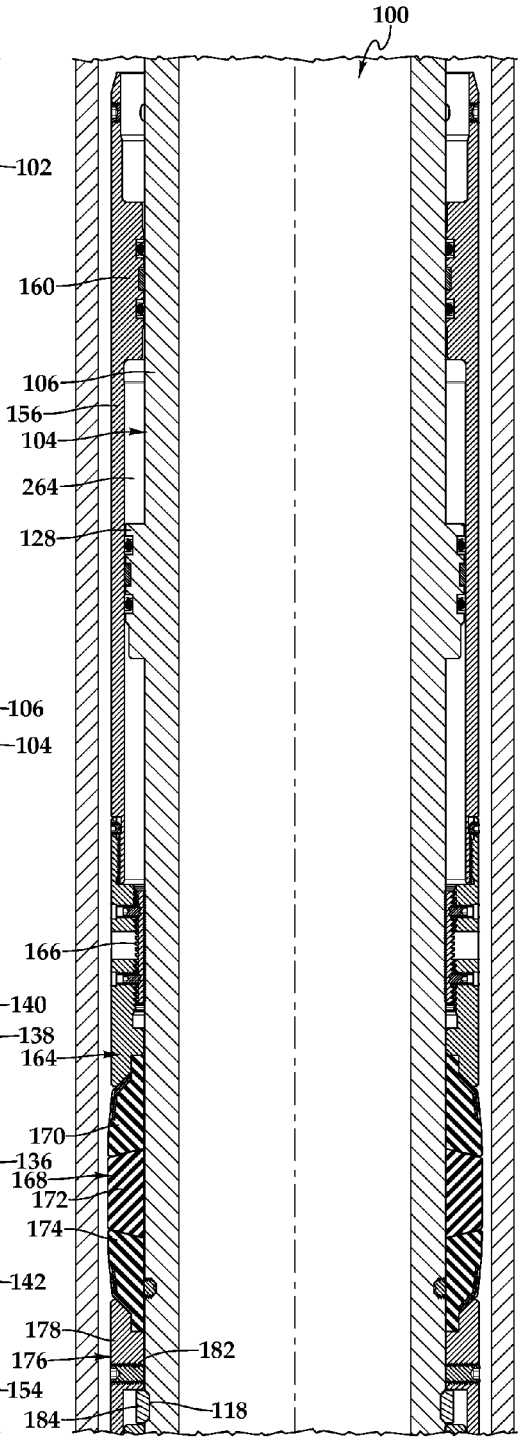
Figures 3C, 3D:
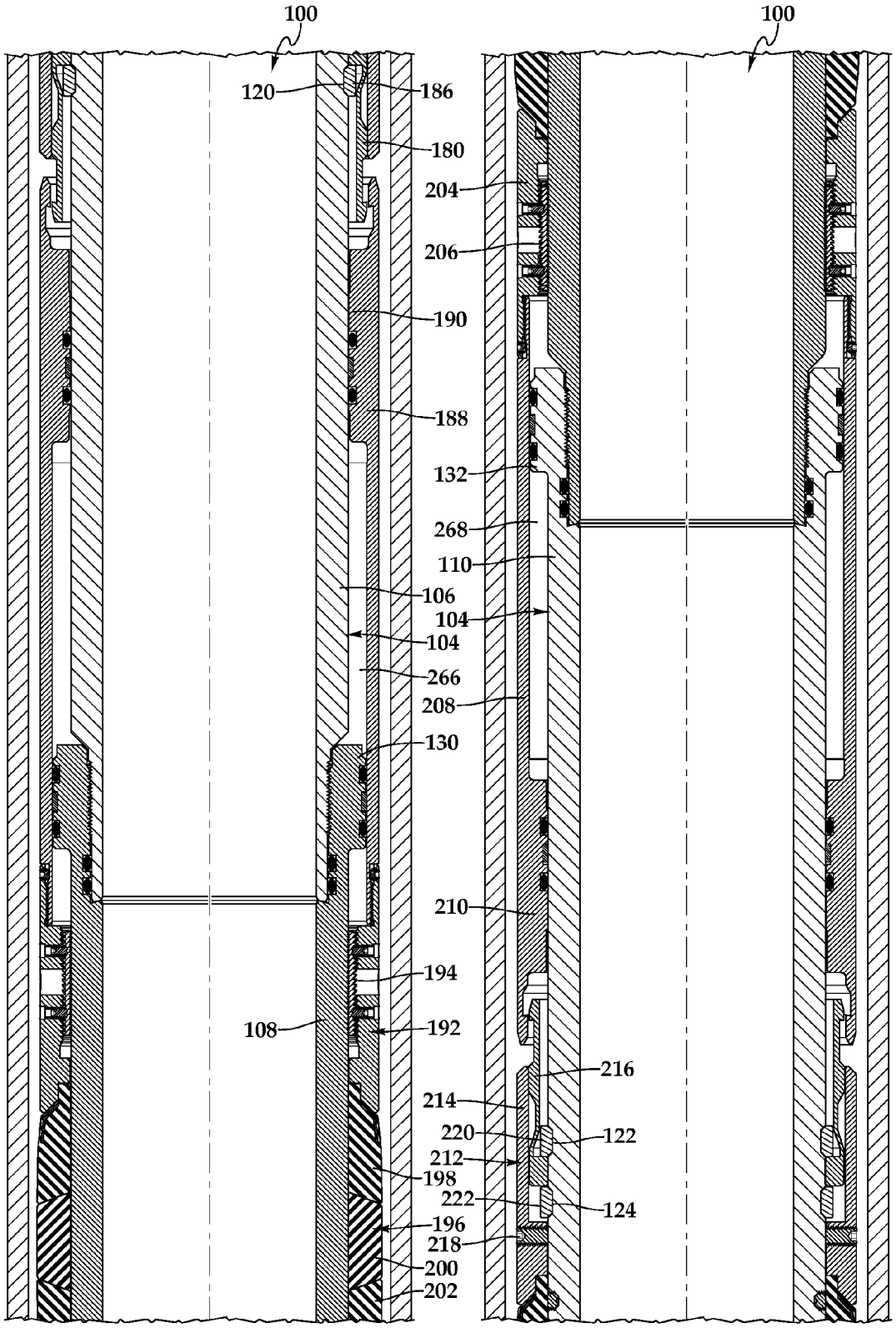
Figures 3E, 3F:
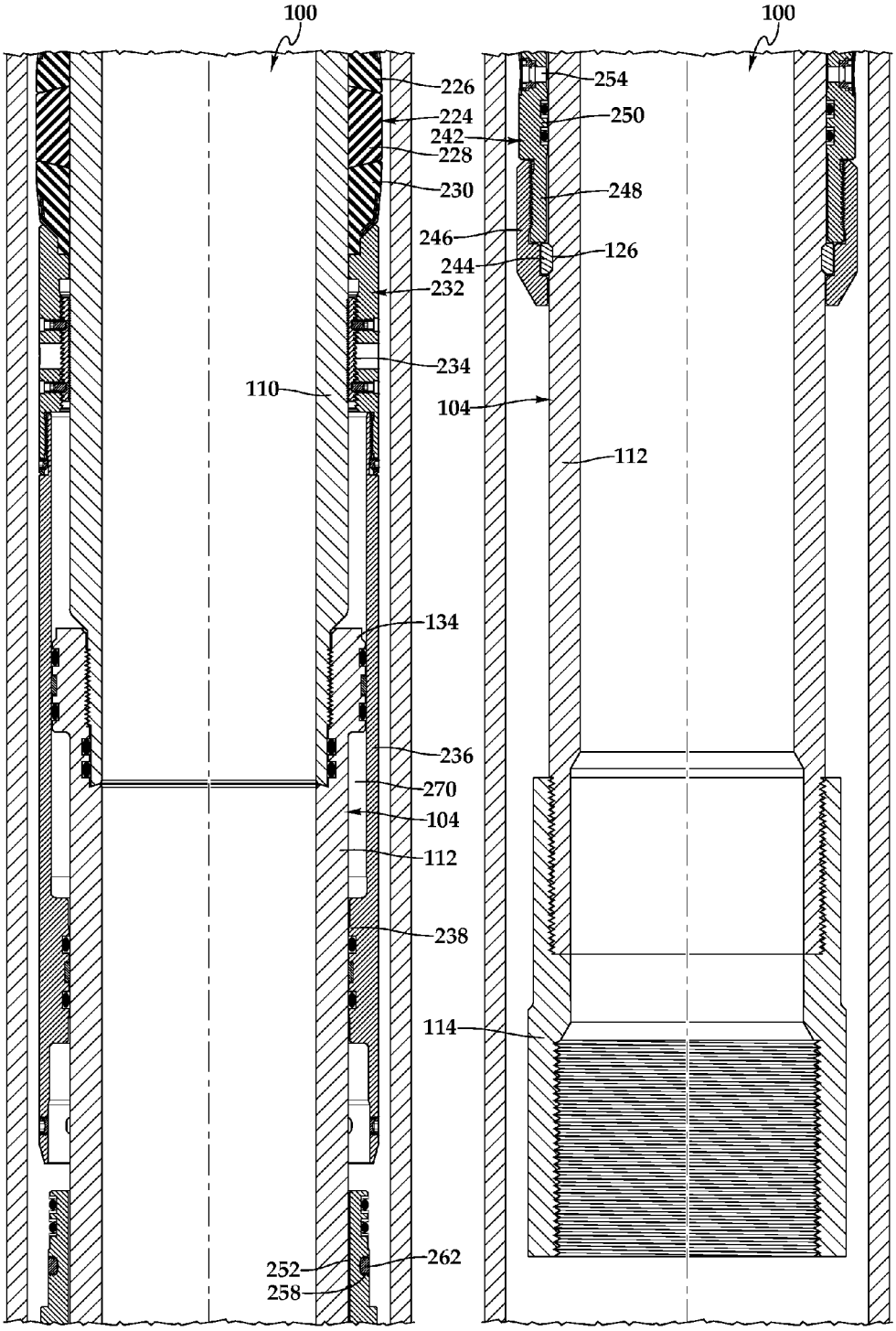

Setting a accomplished by increasing the wellbore or annulus pressure surrounding packer assembly 100 to an actuation pressure sufficient to substantially simultaneously or sequentially burst rupture disks 150, 256. For example, when the actuation pressure of rupture disks 256 is reached and rupture disks 256 burst, fluid pressure from the wellbore enters activation chamber 252 via fluid passageway 254. The force generated by the fluid pressure acting on a lower surface of lower piston 236 breaks the shear screws 262 allowing lower piston 236 to move upwardly against any opposing force generated by pressure within atmospheric chamber 270, which is preferably negligible. Lower piston 236 moves together with body lock assembly 232 to apply a compressive force against seal assembly 224. When the compressive force reaches a predetermined level, shear screws 218 break allowing release sleeve 214 to shift upwardly relative to packer mandrel 104. The upwardly moving release sleeve 214 contacts collet assembly 216 causing radial retraction of the collet fingers of collet assembly 216, decoupling collet assembly 216 from lower intermediate piston 208, as best seen in FIG. 3D.

Preferably, at the same time, when the actuation pressure of rupture disks 150 is reached and rupture disks 150 burst, fluid pressure from the wellbore enters activation chamber 146 via fluid passageway 148. The force generated by the fluid pressure acting on an upper surface of upper piston 156 breaks the shear screws 162 allowing upper piston 156 to move downwardly against any opposing force generated by pressure within atmospheric chamber 264, which is preferably negligible. Upper piston 156 moves together with body lock assembly 164 to apply a compressive force against seal assembly 168. When the compressive force reaches a predetermined level, shear screws 182 break allowing release sleeve 178 to shift downwardly relative to packer mandrel 104. The downwardly moving release sleeve 178 contacts collet assembly 180 causing radial retraction of the collet fingers of collet assembly 180, decoupling collet assembly 180 from upper intermediate piston 188, as best seen in FIG. 3C.

Figure 4A:
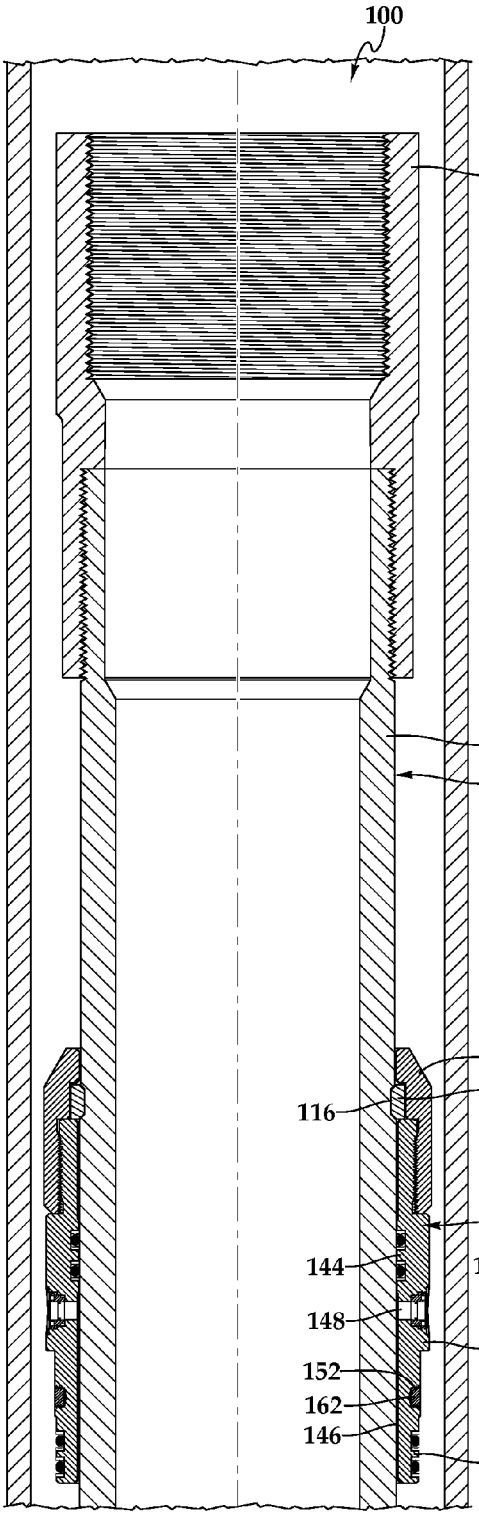
FIGS. 4A-4F are cross-sectional views of consecutive axial sections of a packer assembly having sequentially operated hydrostatic pistons for interventionless setting of multiple seal assemblies in accordance with an embodiment of the present invention in a set configuration.
Figure 4B:
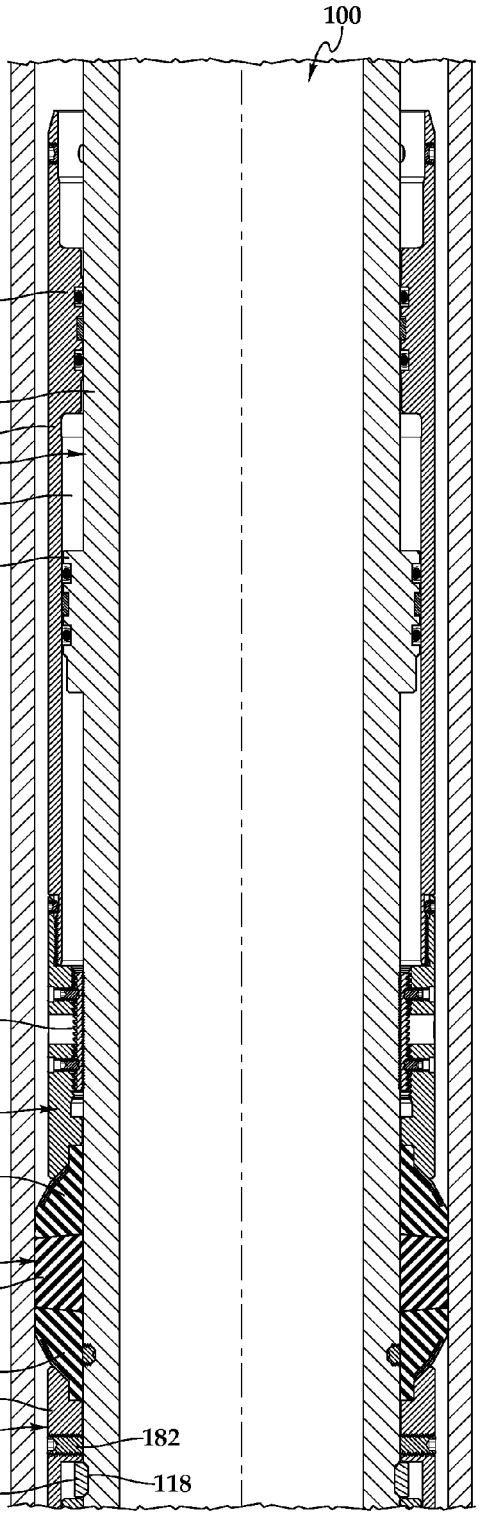
Figures 4C, 4D:
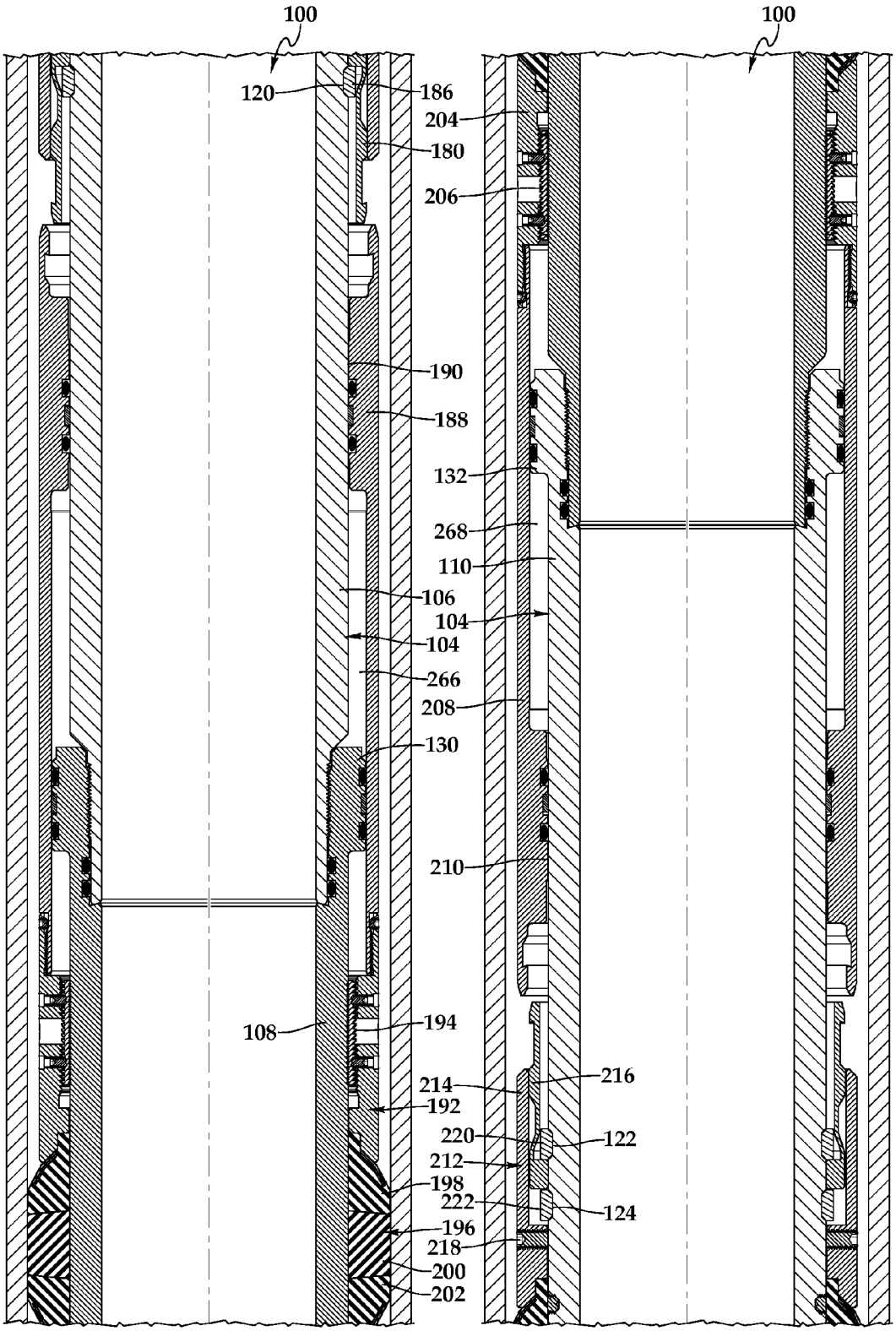
Figures 4E, 4F:
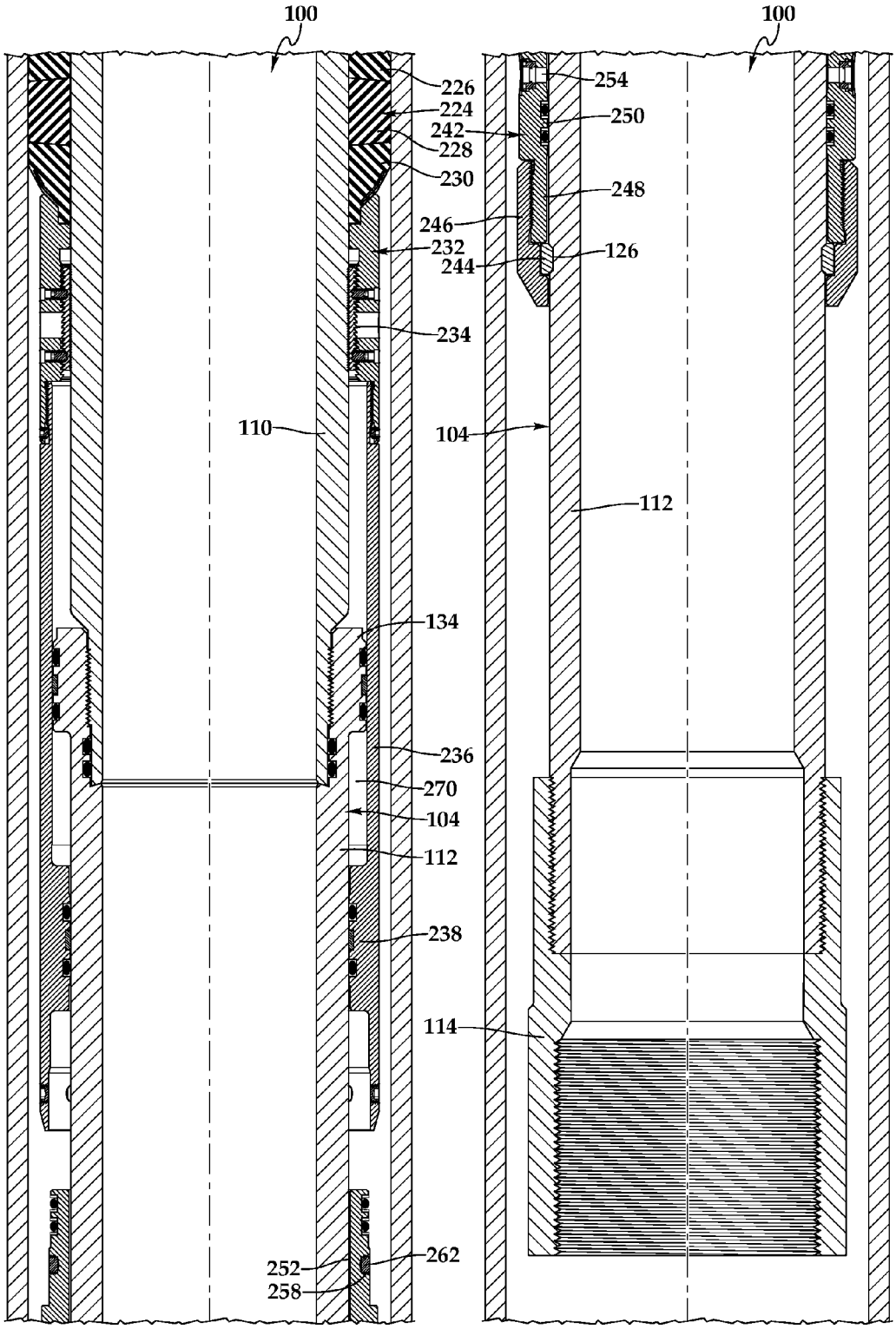

Thereafter, the hydrostatic pressure in the wellbore acts on lower piston 236, lower intermediate piston 208, upper piston 156 and upper intermediate piston 188. Specifically, the hydrostatic pressure continues to act on a lower surface of lower piston 236 to upwardly shift lower piston 236 relative to packer mandrel 104. This upward movement shifts body lock assembly 232, seal assembly 224 and release sleeve 214 until further upward movement of release sleeve 214 is limited by connection ring 222. A compressive force is then applied to seal assembly 224 between body lock assembly 232 and release sleeve 214 which causes radial expansion of seal elements 226, 228, 230, as best seen in FIG. 4E. The hydrostatic pressure also continues to act on an upper surface of upper piston 156 to downwardly shift upper piston 156 relative to packer mandrel 104. This downward movement shifts body lock assembly 164, seal assembly 168 and release sleeve 178 until further downward movement of release sleeve 178 is limited by connection ring 184. A compressive force is then applied to seal assembly 168 between body lock assembly 164 and release sleeve 178 which causes radial expansion of seal elements 170, 172, 174, as best seen in FIG. 4B.

In addition, the hydrostatic pressure now acts on a lower surface of lower intermediate piston 208 operating against any opposing force generated by pressure within atmospheric chamber 268, which is preferably negligible. This upward movement of lower intermediate piston 208 shifts body lock assembly 204. At the same time, the hydrostatic pressure acts on an upper surface of upper intermediate piston 188 operating against any opposing force generated by pressure within atmospheric chamber 266, which is preferably negligible. This downward movement of upper intermediate piston 188 shifts body lock assembly 192. The simultaneous upward movement of body lock assembly 204 and downward movement of body lock assembly 192 applies a compressive force against seal assembly 196 which causes radial expansion of seal elements 198, 200, 202, as best seen in FIG. 4C.

In this manner, actuation of activation assembly 248 causes the sequential operation of lower piston 236 and lower intermediate piston 208 to set seal assemblies 224, 196. Likewise, actuation of activation assembly 142 causes the sequential operation of upper piston 156 and upper intermediate piston 188 to set seal assemblies 168, 196. Even though packer assembly 100 has been described as sequentially operating two pistons responsive to actuation of an activation assembly, it should be understood by those skilled in the art that any number of pistons could alternatively be operated in a sequential manner, for example, using multiple release assembly stages, without departing from the principle of the present invention. Once set, the sealing and gripping relationship between seal assembly 224 and the wellbore setting surface is maintained by body lock ring 234, which prevents loss of compression on seal assembly 224. Likewise, the sealing and gripping relationship between seal assembly 168 and the wellbore setting surface is maintained by body lock ring 166 which prevents loss of compression on seal assembly 168. Similarly, the sealing and gripping relationship between seal assembly 196 and the wellbore setting surface is maintained by body lock rings 194, 206 which prevent loss of compression on seal assembly 224. In this configuration, wellbore pressure above packer assembly 100 tends to further compress seal assembly 168 due to the downward force applied on upper piston 156. Likewise, wellbore pressure below packer assembly 100 tends to further compress seal assembly 224 due to the upward force applied on lower piston 236. Further, if a leak were to develop relative to seal assembly 168, wellbore pressure above packer assembly 100 would tend to further compress seal assembly 196 due to the downward force applied on upper intermediate piston 188. Likewise, if a leak were to develop relative to seal assembly 224, wellbore pressure below packer assembly 100 would tend to further compress seal assembly 196 due to the upward force applied on lower intermediate piston 208.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A packer assembly for use in a wellbore comprising:
- a packer mandrel;
- a first piston slidably disposed about the packer mandrel defining a first chamber therewith;
- an activation assembly disposed about the packer mandrel initially preventing movement of the first piston;
- a first seal assembly disposed about the packer mandrel and operably associated with the first piston;
- a second piston slidably disposed about the packer mandrel defining a second chamber therewith;
- a release assembly disposed about the packer mandrel initially preventing movement of the second piston; and
- a second seal assembly disposed about the packer mandrel and operably associated with the second piston;
- wherein, actuation of the activation assembly allows a force generated by a pressure difference between the wellbore and the first chamber to shift the first piston in a first direction toward the first seal assembly to radially expand the first seal assembly and to actuate the release assembly; and
- wherein, actuation of the release assembly allows a force generated by a pressure difference between the wellbore and the second chamber to shift the second piston in the first direction toward the second seal assembly to radially expand the second seal assembly.

2. The packer assembly as recited in claim 1 wherein the activation assembly further comprises:
- a housing section at least partially disposed about the packer mandrel defining an activation chamber with the packer mandrel and the first piston; and
- a pressure actuated element positioned in a fluid flow path between the wellbore and the activation chamber initially preventing fluid flow therethrough until wellbore pressure exceeds a predetermined actuation pressure.

3. The packer assembly as recited in claim 2 further comprising a frangible member initially coupling the first piston to the housing section.

4. The packer assembly as recited in claim 1 wherein the release assembly further comprises:
- a release sleeve disposed about the packer mandrel and operably associated with the first seal assembly; and
- a collet assembly disposed about the packer mandrel initially preventing movement of the second piston.

5. The packer assembly as recited in claim 4 further comprising a frangible member initially coupling the release sleeve to the packer mandrel.

6. The packer assembly as recited in claim 5 wherein actuation of the release assembly further comprises breaking the frangible member responsive to the first piston shifting in the first direction toward the first seal assembly and shifting the release sleeve in the first direction relative to the collet assembly.

7. The packer assembly as recited in claim 1 further comprising a first body lock ring disposed about the packer mandrel operable to prevent release of the first seal assembly after radial expansion of the first seal assembly.

8. The packer assembly as recited in claim 1 further comprising at least one second body lock ring disposed about the packer mandrel operable to prevent release of the second seal assembly after radial expansion of the second seal assembly.

9. A method for setting a packer assembly in a wellbore, the method comprising:

providing a packer assembly having a packer mandrel with first and second seal assemblies disposed thereabout;

running the packer assembly into the wellbore;

preventing movement of a first piston toward the first seal assembly with an activation assembly disposed about the packer mandrel;

preventing movement of a second piston toward the second seal assembly with a release assembly disposed about the packer mandrel;

actuating the activation assembly to allow a force generated by a pressure difference between the wellbore and a first chamber defined between the first piston and the packer mandrel to shift the first piston in a first direction toward the first seal assembly to radially expand the first seal assembly; and actuating the release assembly responsive to the shifting of the first piston to allow a force generated by a pressure difference between the wellbore and a second chamber defined between the second piston and the packer mandrel to shift the second piston in the first direction toward the second seal assembly to radially expand the second seal assembly.

10. The method as recited in claim 9 wherein actuating the activation assembly further comprises bursting a pressure actuated element responsive to an increase in wellbore pressure to a predetermined actuation pressure.

11. The method as recited in claim 10 wherein actuating the activation assembly further comprises pressurizing an activation chamber disposed between a housing section, the packer mandrel and the first piston.

12. The method as recited in claim 11 wherein actuating the activation assembly further comprises exposing a first piston area of the first piston to wellbore pressure.

13. The method as recited in claim 12 wherein actuating the activation assembly further comprises breaking a frangible member coupling the first piston to the housing section.

14. The method as recited in claim 9 wherein actuating the releases assembly further comprises breaking a frangible member coupling a release sleeve to the packer mandrel.

15. The method as recited in claim 14 wherein actuating the releases assembly further comprises radially inwardly compressing a collet assembly with the release sleeve.

16. The method as recited in claim 15 wherein actuating the releases assembly further comprises unlatching the second piston from the collet assembly.

17. A packer assembly for use in a wellbore comprising:

a packer mandrel;

a first piston slidably disposed about the packer mandrel defining a first chamber therewith;

an activation assembly disposed about the packer mandrel initially preventing movement of the first piston;

a seal assembly disposed about the packer mandrel and operably associated with the first piston;

a second piston slidably disposed about the packer mandrel defining a second chamber therewith; and a release assembly disposed about the packer mandrel initially preventing movement of the second piston;

wherein, actuation of the activation assembly allows a force generated by a pressure difference between the wellbore and the first chamber to shift the first piston in a first direction toward the seal assembly to radially expand the seal assembly and to actuate the release assembly; and wherein, actuation of the release assembly allows a force generated by a pressure difference between the wellbore and the second chamber to shift the second piston in the first direction.

18. The packer assembly as recited in claim 17 wherein the activation assembly further comprises:

a housing section at least partially disposed about the packer mandrel defining an activation chamber with the packer mandrel and the first piston; and a pressure actuated element positioned in a fluid flow path between the wellbore and the activation chamber initially preventing fluid flow therethrough until wellbore pressure exceeds a predetermined actuation pressure.

19. The packer assembly as recited in claim 17 wherein the release assembly further comprises:

a release sleeve disposed about the packer mandrel and operably associated with the first seal assembly; and a collet assembly disposed about the packer mandrel initially preventing movement of the second piston.

20. The packer assembly as recited in claim 17 further comprising a body lock ring disposed about the packer mandrel operable to prevent release of the seal assembly after radial expansion of the seal assembly.

* * * * *